US007789491B2

(12) United States Patent
Watanabe

(10) Patent No.: US 7,789,491 B2
(45) Date of Patent: Sep. 7, 2010

(54) INKJET HEAD AND METHOD OF MANUFACTURING INKJET HEAD

(75) Inventor: Hideo Watanabe, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 467 days.

(21) Appl. No.: 11/459,667

(22) Filed: Jul. 25, 2006

(65) Prior Publication Data

US 2007/0030316 A1 Feb. 8, 2007

(30) Foreign Application Priority Data

Aug. 2, 2005 (JP) ..... 2005-224481
Jun. 8, 2006 (JP) ..... 2006-160009

(51) Int. Cl.
*B41J 2/045* (2006.01)
*H04R 7/00* (2006.01)

(52) U.S. Cl. ..... 347/68; 29/25.35

(58) Field of Classification Search ..... 347/68, 347/70–72; 29/25.35

See application file for complete search history.

(56) References Cited

U.S. PATENT DOCUMENTS

2002/0004295 A1* 1/2002 Harajiri ..... 438/586
2004/0130602 A1* 7/2004 Watanabe ..... 347/68

* cited by examiner

*Primary Examiner*—An H Do
(74) *Attorney, Agent, or Firm*—Lucas & Mercanti, LLP

(57) ABSTRACT

In a method of manufacturing an inkjet head having head chip 1, including driving walls 13 composed of piezoelectric element and channels 14 arranged alongside alternatively, an outlet port and an inlet port provided on front and rear surfaces respectively for each channel, and driving electrode 15 to apply drive voltage to driving wall 13 formed inside the channel, jets ink in channel 14 from a nozzle by causing shear deformation to driving wall 13 by applying voltage to electrode 15, wherein the groove is cut on the rear surface of the head chip across a channel array substantially parallel so as to cut away a portion of the driving walls 13 to a predetermined depth.

10 Claims, 10 Drawing Sheets

FIG. 3 ( a )
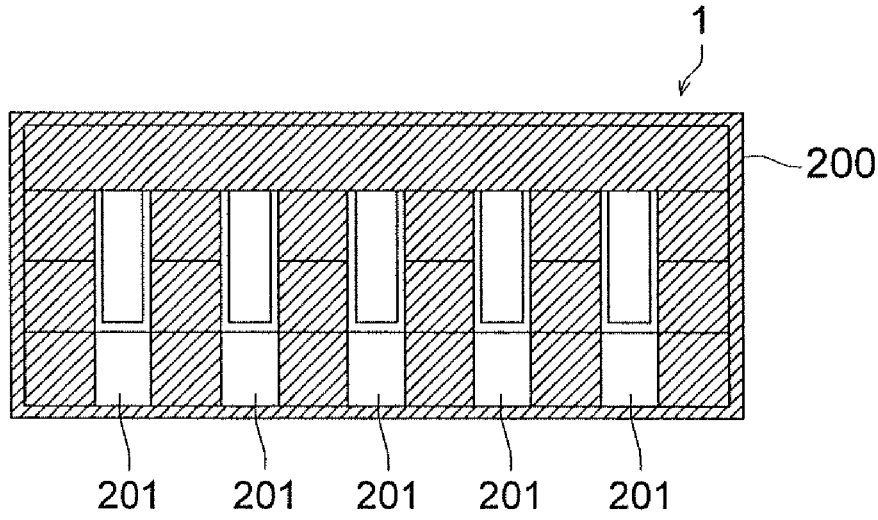
FIG. 3 ( b )
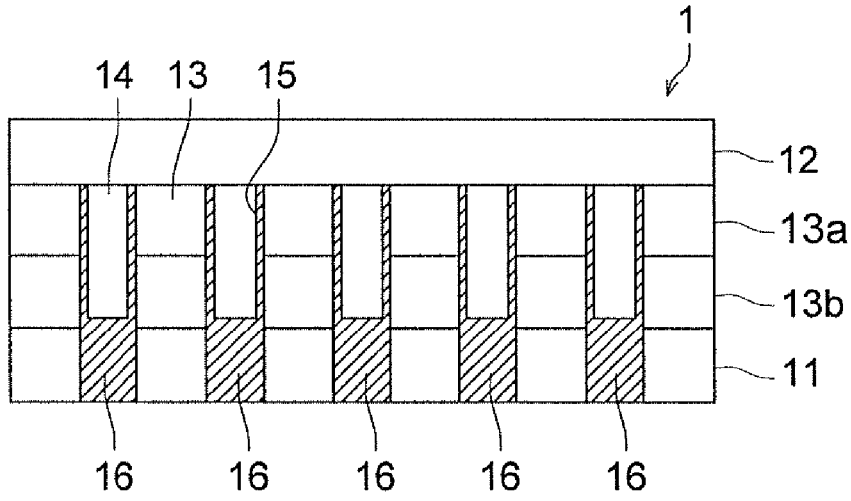

FIG. 14 ( a )
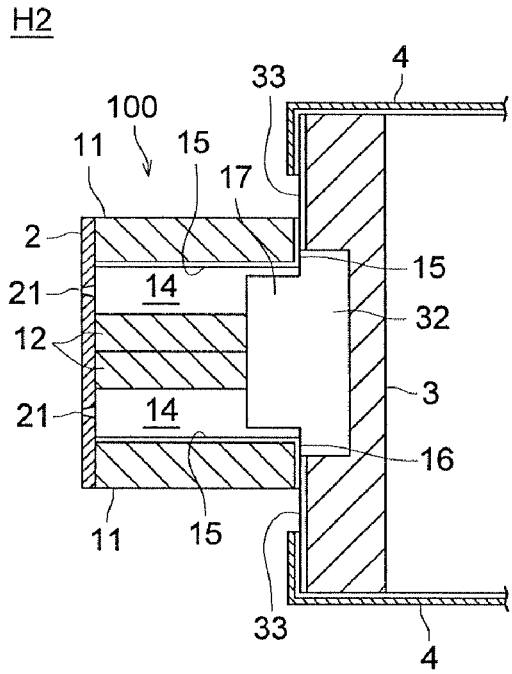
FIG. 14 ( b )
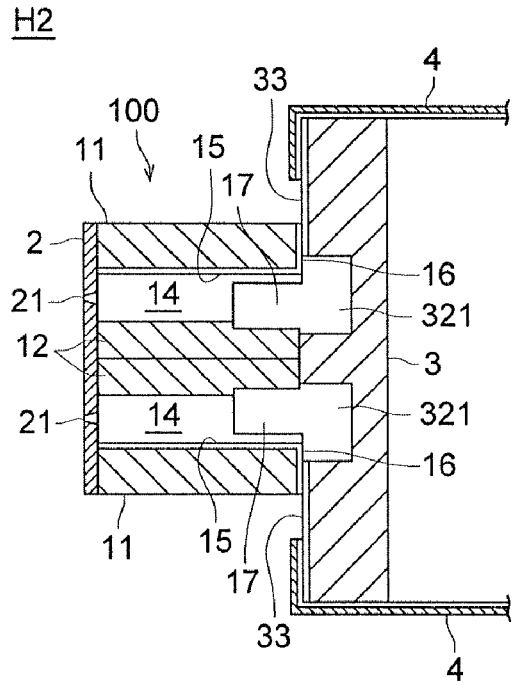

INKJET HEAD AND METHOD OF MANUFACTURING INKJET HEAD

This application is based on Japanese Patent Application No. 2005-224481 filed on Aug. 2, 2005, and No. 2006-160009 filed on Jun. 8, 2006, in Japanese Patent Office, the entire content of which is hereby incorporated by reference.

BACKGROUND OF THE INVENTION

The present invention relates to a manufacturing method of an inkjet head and to the inkjet head, and in particular, to a manufacturing method of inkjet heads each having a common outer dimension and a different channel characteristic and to the inkjet heads.

There has been known a shearing mode type inkjet head wherein a channel is formed on a piezoelectric substrate by grinding, an electrode is formed on a driving wall which separates the channel, and ink in the channel is jetted by applying voltage to the electrode so as to cause dogleg-shaped shear deformation to the driving wall. Among them, there has been known, for example, in Patent Document 1, an inkjet head whose productivity is highly improved because a number of head chips can be obtained in a wafer by configuring an actuator for jetting ink with so-called a harmonica type head chip where the driving wall composed of a piezoelectric element and the channel are arranged alongside alternatively and an inlet port and an out let port of each channel are provided on a front surface and a rear surface.

Meanwhile, generally, in a type of inkjet head where jetting energy is applied by causing dogleg-shaped distortion to the driving wall, an optimum drive pulse width to drive is determined by the channel characteristic. The channel characteristic is determined by a length (driving length or L length, hereinafter called L length in this specification) along a direction of ink jetting, accordingly a drive frequency is also determined. For example, in case an inkjet head required to be driven in a high frequency as a channel characteristic, L length becomes shorter, and an inkjet head having extremely short L length of 1.7 mm is being manufactured.

Also, in Patent Document 2, a channel is formed on the front and the rear surfaces of the head to be utilized for connecting the electrode.

(Patent Document 1) Unexamined Japanese Patent Application Publication No. Tokkai 2005-96414

(Patent Document 2) Unexamined Japanese Patent Application Publication No. Tokkaihei 8-30997

In case of inkjet head having the harmonica type head chip, L length itself is a length of head chip (the length along the ink jetting direction of the channel) and because L length becomes shorter as the drive frequency becomes higher, assembling of the inkjet head becomes difficult and the strength of the head chip decreases, thus special care is needed to handle it, and a difficulty of mounting on a housing was a problem.

Also, the inkjet head is mounted on the housing using a nozzle surface as a positioning surface, if L length is changed, design of the housing has to be changed accordingly. Thus since exclusive housings are needed to be prepared for each L length, cost increase was a problem.

SUMMARY OF THE INVENTION

Thus an object of the present invention is to provide a method of manufacturing an inkjet head which enables to manufacture an inkjet head having various characteristics in a common outer dimension.

Another object is to provide an inkjet head in which strength of the chip and easiness of mounting to the housing are maintained irrespective of the required channel characteristic.

Other objects of the present invention are clarified in the following description.

The above objects are solved by the followings.

(1) In a method of manufacturing an inkjet head having a head chip in which driving walls configured with piezoelectric elements and channels are arranged alongside alternatively, inlet port and outlet port of each channel are arranged on a front surface and on a rear surface, and electrodes to apply voltage for driving the driving walls are formed, wherein ink in the channel is jetted by applying voltage to the electrode so as to cause shear deformation to the driving wall, after forming the electrode on the head chip, a groove is cut on the rear surface of the head chip across a channel array substantially parallel so as to cut away at least a portion of the driving walls to a predetermined depth.

(2) In the method of manufacturing the inkjet head of item (1), the groove is cut so that a desired drive length (L length) is obtained.

(3) In the method of manufacturing the inkjet head of item (1) or (2), the groove is cut through a dicing saw along the channel array.

(4) In the method of manufacturing the inkjet head according to any one of items (1) to (3), the groove is cut so that a part of the driving electrode remains.

(5) In the method of manufacturing the inkjet head according to any one of items (1) to (4), a plurality of channel arrays are provided and the groove is cut to correspond with each channel array.

(6) In the method of manufacturing the inkjet head according to any one of items (1) to (4) a plurality of channel arrays are provided and the groove is cut across the channel arrays.

(7) In an inkjet head having a head chip in which driving walls configured with piezoelectric elements and channels are arranged alongside alternatively, an outlet port and an inlet port of each channel are arranged on a front surface and on a rear surface respectively, and an electrode to apply voltage for driving the driving wall is formed, wherein ink in the channel is jetted by applying voltage to the electrode so as to cause shear deformation to the driving wall, there is provided a concave groove which is formed parallel to the channel array on the rear surface of the head chip and communicating with each channel.

(8) In the inkjet head of (7), the concave groove is formed so that a part of the driving electrode formed in the channel remains.

(9) In the inkjet head of item (7) or (8), a plurality of channel arrays are provided and the concave groove is formed to correspond with each channel array.

(10) In the inkjet head of item (7) or (8), a plurality of channel arrays are provided and the concave groove is formed across the plurality of channel arrays.

(11) In the inkjet head according to any one of items (7) to (10), a connection electrode to be connected with the driving electrode electrically is formed on the rear surface of the head chip, a wiring substrate where wiring electrodes to correspond with the connection electrodes is formed, is bonded so that the connection electrode is connected electrically with one end of the wiring electrode, the wiring substrate has a jetty section which is projecting beyond the head chip in a direction perpendicular to the channel array, and the other end of the wiring electrode is extended to the jetty section.

(12) In the inkjet head of item (11), the wiring substrate has a concave section which extends along a direction of the channel array, and is bonded at rear surface of the head chip so that the concave section covers the inlet port of the channel, thus, an ink supply chamber to supply ink commonly to inside the channel is formed by the concave section.

(13) In the inkjet head of item (11), the wiring substrate has an opening section opening towards at least to the inlet port of the channel, and an common ink chamber to supply ink commonly to inside the channel is formed by the opening section.

(14) In the inkjet head according to any one of items (7) to (13), a drive length (L length) of the channel is 0.5 to 1.5 mm and a head chip length is 1.5 mm to 2.5 mm.

In item (1), since inkjet heads having various channel characteristics with a common outer dimension can be manufactured, strength and easiness of handling can be acquired, and since a common housing can be utilized irrespective of characteristics of the channel, cost reduction can be realized.

In item (2), an inkjet head having a desirable channel characteristic can be manufactured easily by cutting the groove so that the drive length (length L) of the channel after cutting the groove becomes a desirable length.

In addition, in item (3), grinding work with highly accurate mechanical positioning is possible and a width and a depth of the groove can be set with high accuracy, thus, the desirable channel characteristic can acquired accurately.

In addition, in item (4), an inkjet head having short L length can be manufactured while maintaining the electrode being connected to outside.

In addition, in item (5), a part of substrate remained at time of cutting the groove can separate each channel, and ink can be supplied respectively for each channel, and thereby, different colors of ink can be supplied to each channel respectively.

In item (6), electrostatic capacity can be reduced since an unnecessary portion for driving is largely removed by cutting the groove, accordingly drive voltage can be reduced, and thereby, generation of heat can be suppressed.

In item (7), because it is possible to provide the inkjet head in which strength of the head chip and easiness of mounting on the housing can be acquired irrespective of required channel characteristic, the strength and the easiness of mounting on the housing are maintained, and the common housing can be used irrespective of the characteristics of the channels, and thereby, a low cost inkjet head can be realized.

In addition in item (8), an inkjet head having short L length while maintaining the electrode being connected with outside can be realized.

Further in item (9), since a part of the substrate separates each channel and ink can be supplied individually to each channel, different color of ink can be jetted to each channel.

Further, in item (10), because the unnecessary portion for driving is largely removed by the concave groove, electrostatic capacity can be reduced, accordingly drive voltage can be reduced, and thereby, generation of heat can be suppressed. Also, it is preferable for supplying ink, since the capacity of the common ink chamber can be made large.

Further, in item (11), an inkjet head where the electrode provided in the channel can easily be connected with an external wire is realized.

Further, in item (12), the capacity of the common ink chamber can be increased and a large amount of ink can be supplied to each channel, and thereby, a stable ink jetting characteristic can be realized.

Further, in item (13), by providing an ink manifold to cover the opening section on a surface opposite to the wiring substrate of the head chip, a large amount of ink can be supplied to each channel and a stable ink jetting characteristic can be realized.

Further, in item (13), an inkjet head having short L length capable of high speed driven, wherein strength of the chip head and handling easiness is maintained can be realized.

BRIEF DESCRIPTION OF THE DRAWINGS

FIG. 3 (*a*) and FIG. 3(*b*) are drawings showing a forming method of a connection electrode.

FIG. 14(*a*) and FIG. 14(*b*) are cross-sectional views showing other embodiments of inkjet heads related to the present invention.

DETAILED DESCRIPTION OF THE PREFERRED EMBODIMENT

An embodiment of the present invention is explained with reference to the following drawings.

Figure 1:
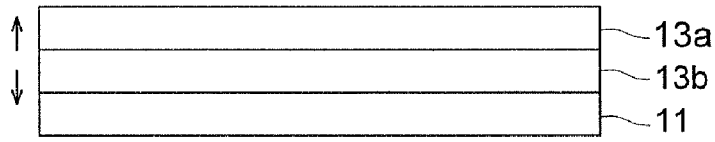
FIG. 1 (*a*) to FIG. 2(*d*) are drawings explaining a manufacturing method of head chip 1 in inkjet head related to the present invention.
Figure 1:
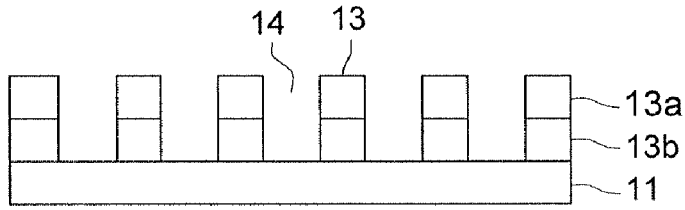
Figure 1:
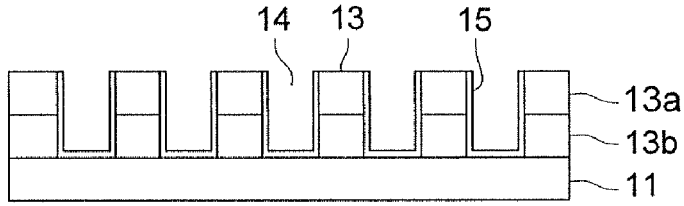
Figure 1:
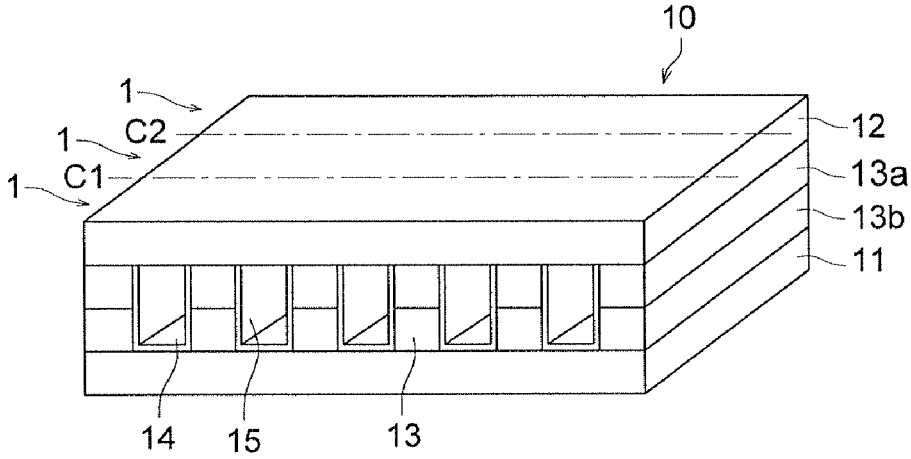

Each of FIG. 1 (*a*) to FIG. (*d*) indicates manufacturing method of the head chip of the inkjet head related to the present invention.

First, on a piece of substrate 11, two pieces of piezoelectric element substrate 13*a* and 13*b* are bonded respectively by an epoxy based adhesive (FIG. 1(*a*)). Lead zirconium titanate (PZT) is particularly preferred as the piezoelectric element substrate, while a publicly known piezoelectric material which deforms by applying voltage can be use. Two pieces of piezoelectric element substrate 13*a* and 13*b* are laminated so that polarization directions oppose each other and are bonded to substrate 11 with an adhesive.

Next, a plurality of parallel channels are formed by grinding through a dicing saw across these two pieces of piezoelectric element substrate 13*a* and 13*b*. In this way, driving wall 13 composed of the piezoelectric element where the polarization directions oppose each other in a vertical direction on substrate 11 is arranged alongside. Each channel becomes straight channel 14 having almost the same size and the same shape in a longitudinal direction by grinding piezoelectric element substrate 13*a* and 13*b* in almost the same depth form one end to the other (FIG. 1 (*b*)). While five channels 14 are formed in the example indicated by the drawing, the number of channels is not limited.

It is further possible to increase a thickness of piezoelectric element substrate 13*b* to eliminate substrate 11, wherein a plurality of channels whose depth reaches to the middle of thick piezoelectric element substrate 13*b* are formed through grinding, thereby driving wall 13 in which the polarizing directions oppose each other are formed, and aforesaid substrate 11 is substituted by piezoelectric element substrate 13*b*.

Next, driving electrode 15 is formed on an inside surface of each channel 14 formed in the above way. Metal materials to from the electrode are Ni, Co, Cu and Al. While Al and Cu are preferred from the viewpoint of electric resistance, Ni is preferably used in terms of corrosion, strength and cost. Also, a laminated structure where Au is laminated on Al can be employed.

While methods to form a metal film using a vacuum device such as evaporation coating method, spattering method, plating method and CVD (chemical vapor deposition method) are quoted as forming methods of driving electrode 15, plating method is preferred and forming by nonelectrolytic plating is particularly preferred. A metal film which is free from pin holes and uniform in thickness can be formed by nonelectrolytic plating. A thickness of plating film is preferred in a range of 0.5-5 μm.

Because driving electrode 15 has to be independent for each channel 14, forming of a metal film is on the top end of driving wall 13 is prevented. For this reason, it is preferable, for example, that a dry film is affixed or a resist is formed on a top end surface of driving wall 13, in advance, then after forming the metal film, the film or the resist is removed. Thus driving electrode 15 is selectively formed on side surfaces of each driving wall 13 and on a bottom surface of each channel 14 (FIG. 1 (*c*)).

After forming driving electrode 15 in the above manner, head substrate 10 is formed by bonding substrate 12 on the top end surface of driving wall 13 by using an epoxy-based adhesive (FIG. 1 (*d*)). For substrata 11 and 12, if the same substrate material as the piezoelectric material constituting driving wall 13 is used after depolarizing, variation of driving characteristic and speed distribution caused by a difference of coefficient of thermal expansion, which is further caused by effects of heat by driving and heating for bonding the substrate is minimized.

Figure 2:
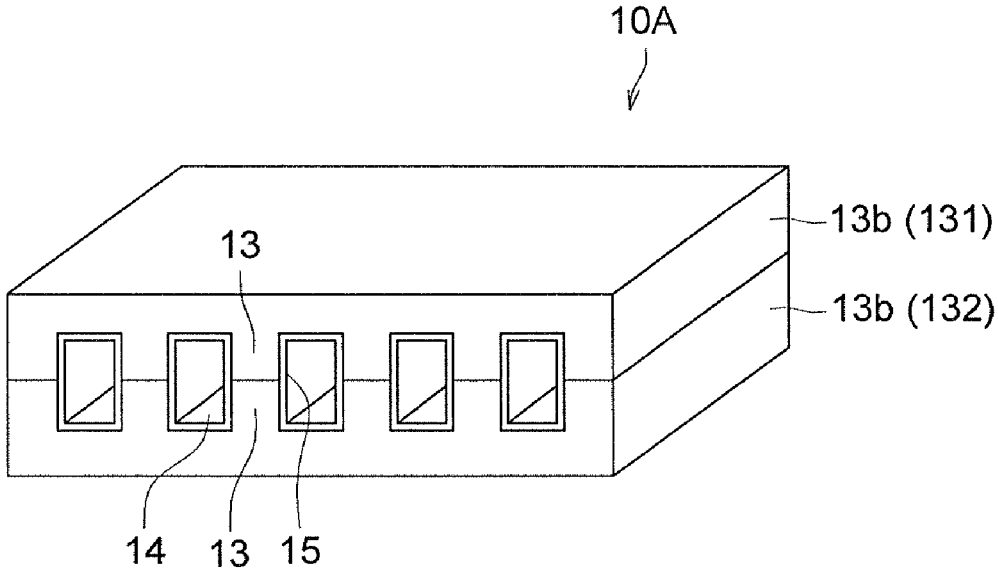
FIG. 2 is a perspective view showing the other embodiment of a head substrate.

Also, such head substrate is not limited to the one manufactured as indicated in FIG. 1, As FIG. 2 shows, instead of using substrate 11, a thickness of piezoelectric element substrate 13*b* is increased, driving wall 13 and channel 14 are arranged alongside alternatively by grinding parallel grooves, two sets (upper substrate 131 and lower substrate 132) of substrata in which driving electrode 15 is formed on inner surface of each channel 14 are prepared, and these substrata are bonded so that driving walls 13 face each other, thereby, head substrate 10A similar to the one in FIG. 1(*d*) is obtained. In this case, since thin piezoelectric element substrate 13*a* does not have to be bonded to 13*b*, it is favorable in terms of cost. However, in the following case, a case using head substrate 10 in FIG. 1(*b*) is explained Next, a plurality of harmonica type chip heads 1 are manufactured by cutting manufactured head substrate 10 along a plurality of cutting lines C1, C2 . . . along a direction perpendicular to a longitudinal direction of channel 14 (FIG. 1 (*d*)).

Usually, cut lines C1, C2 . . . determine a length along a direction of ink jetting of head chips 1 manufactured by C1, C2 . . . and generally, the length in channel direction of head chips 1 after cutting along cutting lines C1, C2 . . . becomes L length. In the present invention, cut lines C1, C2 . . . are not necessary to be adjusted to the required L length for each head chip 1 and the positions of cut lines C1, C2 . . . are determined so that head chips 1 have only to be in the same appropriate length, considering the strength of head chip 1 itself, workability of assembling the inkjet head and workability when mounting the inkjet head on a housing. In this way, a plurality of head chips 1 in which all channels 14 have a common length are obtained.

In the present invention, it is preferred that cut lines C1, C2 . . . are positioned so that L length is at least not less than a maximum length required for the inkjet head. For an example, taking account 0.3 mm as a cutting allowance of cut lines C1, C2 . . . , a distance between cut lines is determined as 2.8 mm. Thus, head chips 1 all having length of 2.5 mm are obtained. If head chip 1 has such length as this, the strength of head chip 1 itself can be sufficiently maintained and no difficulty is caused in workability of assembling the inkjet head and workability when mounting the inkjet head on a housing.

In each of head chips 1 manufactured in this way, driving wall 13 composed of piezoelectric element and channel 14 are arranged alongside alternatively between substrate 11 and 12. Each channel 14 has a shape wherein both side walls are substantially perpendicular to substrates 11 and 12, and are parallel each other. On a front surface and a rear surface of head chip 1, outlet port 142 and inlet port 141 for each channel 14 are provided respectively. Each channel 14 is a straight type which maintains almost the same length and the same shape in a longitudinal direction from the inlet port to the outlet port.

Meanwhile, in this specification, "front surface" means a surface where ink is jetted from head chip 1 and "rear surface" means a surface opposite to the front surface. Also, when viewing head chip 1 from the front surface or the rear surface, outer surfaces positioned on top and bottom where channel 14 arranged alongside is interposed are called "upper surface" and "lower surface" respectively.

In such harmonica type chip head 1, it is necessary to extend each driving electrode 15 to outside of chip head 1 so that wiring such as FPC (flexible printed circuit) is connected for applying drive voltage from a drive circuit to driving electrode 15 in each channel 14. Then, next, on the rear surface of head chip 1, the connection electrode 16 is formed by extending from a part of driving electrode 15 which is formed on the bottom surface (a surface of substrate 11 facing inside channel 14) of channel 14 to the rear end surface of substrate 11.

FIG. 3(*a*) and FIG. 3(*b*) are explanatory drawings explaining an example of a method of forming connection electrodes to be connected with each driving electrode 15 by extending to outside of head chip 1.

As FIG. 3(*a*) shows, connecting electrode 16 can be formed through the step, wherein a photoconductive dry film 200 having opening section 201 which exposes the rear end surface of substrate 11 including at least a portion of drive channel 15 formed on the bottom surface of channel 14, is affixed on one of cutting surfaces (rear surface) of head chip 1, and a metal film is created in opening section 201 by evaporating a metal such as Al for forming electrode.

To connect driving electrode 15 in channel 14 with connection electrode 16 smoothly, it is favorable to tilt the rear surface of head chip 1 in a predetermined angle for evaporating coating, but not to erect the rear surface of head chip 1 against an evaporating direction. Specifically, it is preferred that an evaporation direction is tilted approximately 30° to 60° upward but not vertical to the paper surface of FIG. 3(*a*).

Also, connection electrode 16 can be a layer structure by a method where Au is further evaporated on the metal film of Al. Furthermore connection electrode 16 can be formed by spattering instead of evaporation.

As FIG. 2 shows, particularly in case head chip 1 is made from substrate 10A by cutting head, driving electrode 15 of upper substrate 131 and driving electrode 15 of lower substrate 132 cannot be connected electrically, since the adhesive is interposed in between. Thus, these two driving electrodes 15 and 15 have to be connected when the metal film is formed inside of opening section 201 of photoconductive dry film 200. In case the electrode is formed by evaporation, electrode forming can be realized by multiple times of evaporation in a predetermined evaporation direction or by changing the direction of the substrate while evaporation. In case of the electrode is formed by spattering, contact of two driving electrodes 15 and 15 can be made without changing the direction of the substrate specifically, since metal particles come flying from various directions.

Meanwhile, opening section 201 is preferred to be opened over entire area of channel 14, considering workability in development and water washing of photoconductive dry film 200. Opening over the entire surface makes removing work of developing fluid and washing water easy.

After that, as FIG. 3 (*b*) shows, by removing photoconductive dry film 200, connection electrodes 16 electrically connected to driving electrode 15 are extended from each channel 14 to a surface (rear surface) of head chip 1 independently for each channel 14.

Figure 4:
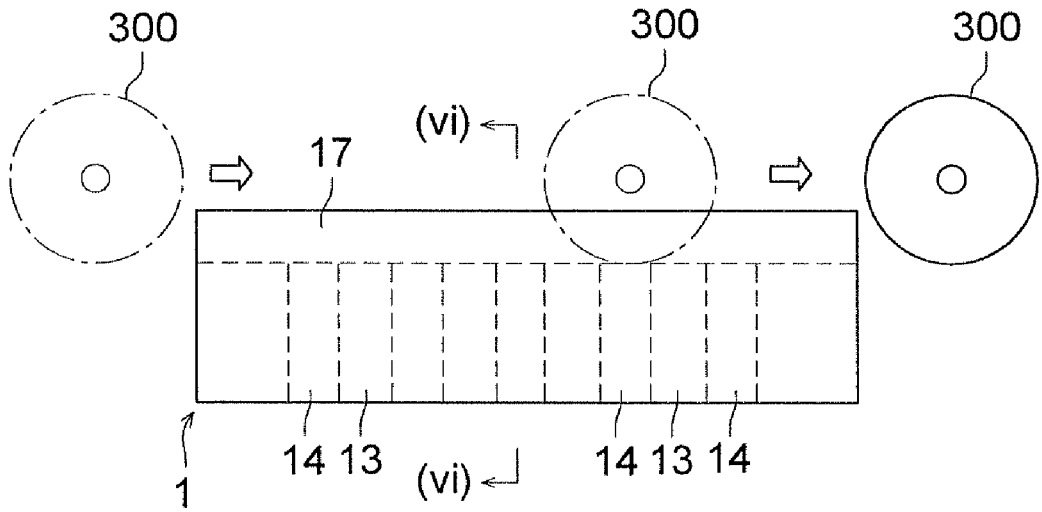
FIG. 4 is a drawing showing a method of cutting the groove.
Figure 5:
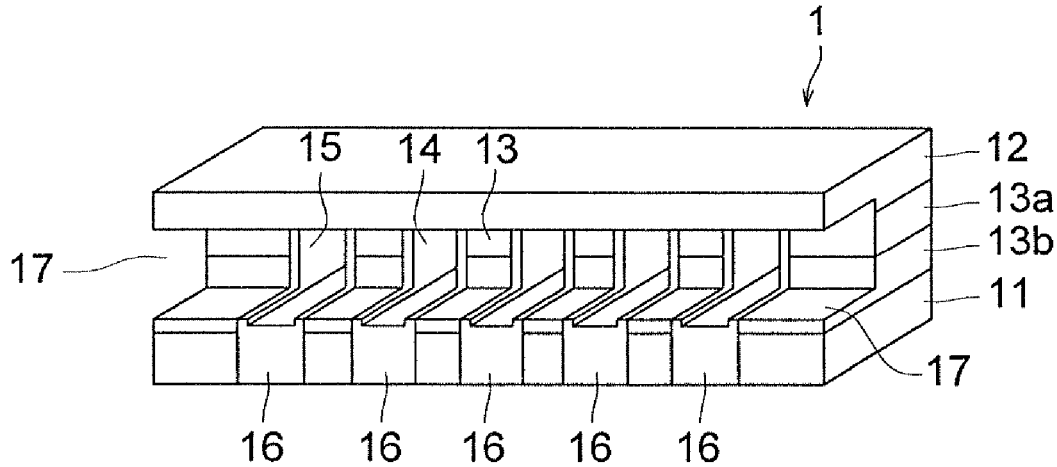
FIG. 5 is a perspective view of a head chip after cutting the groove seen from a rear surface side.
Figure 6:
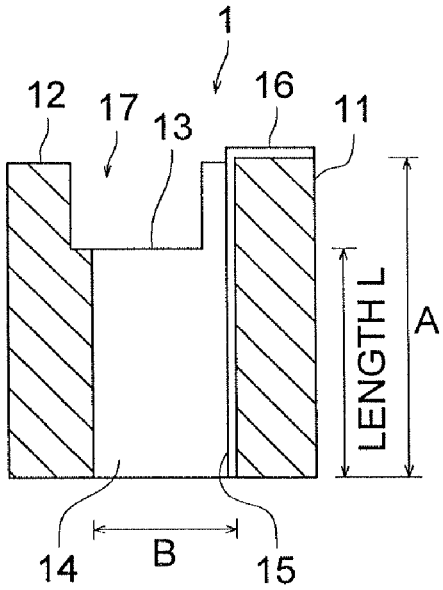
FIG. 6(*a*) and FIG. 6(*b*) are cross-sectional views of the head chip where the groove is cut in different depths respectively.
Figure 6:
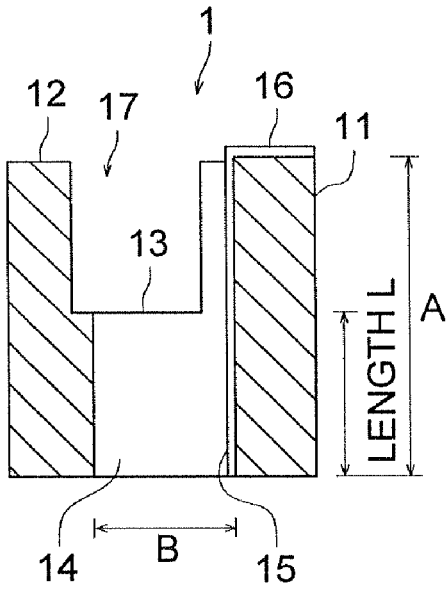

Here, since each chip head 1 cut from head substrate 10, is made so that the length of channels 14 is common for all head chips, each head chip is needed to have characteristics individually required, which are individually desired L lengths. Then, as FIG. 4 shows, the groove is cut on the rear surface of each chip head 1 through dicing saw 300 in a depth so that channel 14 after cutting groove has a desired L length. FIG. 4 is a view of head chip 1 observed from substrate 11 side, FIG. 5 shows a perspective view of head chip 1 observed from the rear surface side. Also, symbol 17 in the drawing represents a groove formed by cutting. FIG. 6 is cross-sectional view of FIG. 4 along (vi)-(vi) line.

The groove is cut on the rear surface of headship 1 after forming driving electrode 15 and connection electrode 16, across the channel array substantially parallel so as to cut away at least a portion of the driving walls. By this groove, a part of driving wall 13 on the rear surface of head chip 1 is removed along the channel array, and groove 17 representing a concave groove communicating with each channel 14 substantially parallel to the channel array is cut.

Dicing saw 300 is capable of grinding work through mechanically accurate positioning, thus a depth and a width of groove 17 to be machined can be set in high accuracy and the groove can be maintained accurately across the desired L length. Therefore, grinding by using such dicing saw is preferable when the groove is.

As a condition of dicing saw, a dicing saw having a width of 0.3 mm is used. If the width of groove 17 is 0.3 mm, the groove has only to be cut one time, and if a groove wider than the width of the dicing saw is formed, a plurality of times of grinding is carried out to obtain groove 17 having the desired width.

Meanwhile, in the present invention, the cutting method of the groove is not limited to dicing saw 300 and any forming method capable of obtaining the same shape can be utilized. For example, a forming method using milling machine and end mill, and a forming method using an abrasive grain and a supersonic processing machine are quoted.

In grove cutting to remove a part of driving wall 13, in order to obtain a desired L length of channel 14 of head chip 1, unnecessary driving wall 13 has only to be removed to some extent where the driving wall 13 is not driven even if a drive voltage is applied, and at least a part of driving wall 13 in channel 14 has only to be cut. However, to avoid disconnection between driving electrode 15 and connection electrode 16, the groove has to be cut to leave a part of driving electrode 15 which is formed inside of channel 14. Namely, as FIG. 6 shows, by cutting the groove so that inner surface (bottom surface) of channel 14 parallel to the machining direction of groove cutting where driving electrode 15 is formed remains, groove 17 does not overlap with a connection area of driving electrode 15 and connection electrode 16, thus, electric connection between driving electrode 15 in each channel 14 and connection electrode 16 is maintained. Thereby, an inkjet head having short L length can be manufactured while maintaining the electrode being led to outside.

Also, as shown in FIG. 6, it is preferred that the groove is cut to an extent where a part of substrate 12 is included.

In the above groove cutting, as FIG. 6(*a*) and FIG. 6(*b*) show, while head chips 1 maintains a common outer dimension in length A, by setting the depth of groove 17 arbitrarily in accordance with L length required for each head chip 1, head chips 1 each having different L length can be realized.

For example, when groove 17 having a depth of 800 μm was formed by cutting the groove on driving wall 13 from the rear surface side of head chip 1, along the channel array so that driving electrode 15 side of the bottom surface of channel 14 remains 20 μm, under a condition that length A of head chip 1 is 2.5 mm which is a suitable dimension for manufacturing, and channel depth B (See FIG. 6) is 310 μm, it was possible to make high frequency driven head chip 1 having L length of 1.7 mm wherein an outer dimension remains unchanged to be 2.5 mm. In addition, though high frequency driven head chip 1 has such short L length, the strength of head chip 1 can be maintained and head chip 1 can be handled without any problem, since the outer dimension remains unchanged to be 2.5 mm which is favorable for manufacturing.

In the present invention, head chip 1 having groove 17, wherein L length of channel 14 is 0.5-1.5 mm and the length of head chip 1 is 1.5-2.5 mm, make it possible to maintain the strength and to offer easy handling, though it is a high frequency driven head chip 1 having a short L length.

Figure 7:
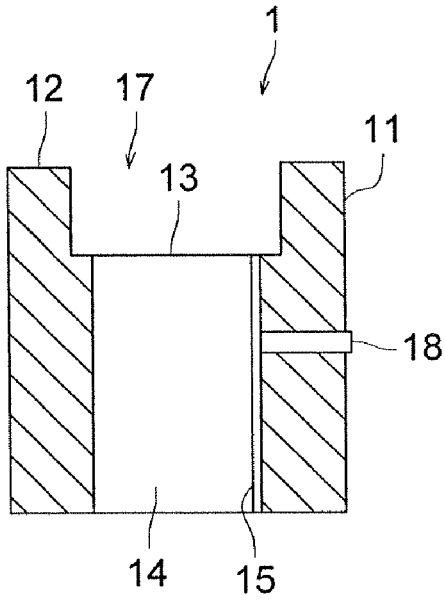
FIG. 7 is a cross-sectional view of the head chip showing a method to provide an electrode which penetrates inside the substrate.

Meanwhile, FIG. 5 and FIG. 6 show examples where connection electrode 16 is extended to the exterior so that driving electrode 15 is connected with an external drive circuits. On the other hand, to connect with the drive circuit, there is a method where the electrode is arranged by penetrating inside substrate 11. FIG. 7 shows a cross-sectional view of head chip 1 according to this method. In substrate 11, penetrating electrode 18 penetrating from the inside of channel 14 to the outside of head chip 1 is formed. An end of penetrating electrode 18 facing the inside of channel 14 is connected to driving electrode 15 electrically. In this case, not as FIG. 5 and FIG. 6, since electric connection between driving electrode 15 and connection electrode 16 is not necessary to be considered, as the drawing shows, it is not a problem even if the width of groove 17 occupies entire inlet side portion of channel 14.

Figure 8:
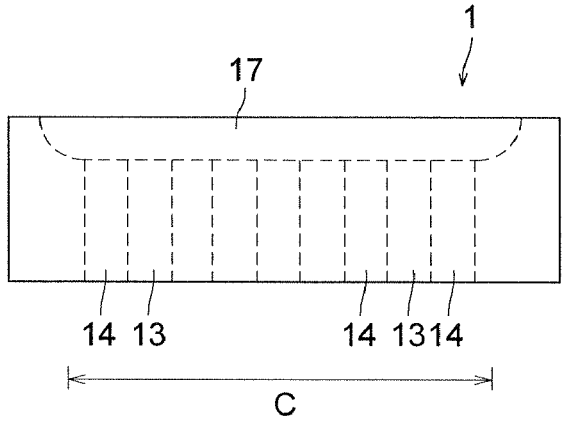
FIG. 8 is a drawing explaining the other method of cutting the groove.

Meanwhile, the groove has only to be cut for a portion which affects the channel characteristic and it is not necessary to form the grove in the same depth from one end of head chip 1 to the other as FIG. 4 shows. Therefore, for example, as FIG. 8 shows, the groove has only to be in the same depth only in area C where channel 14 is formed. In this case, since both ends of groove 17 do not open at both ends of head chip 1, plugging is not necessary to avoid occurrence of ink leak form both ends of head chip 1.

Figure 9:
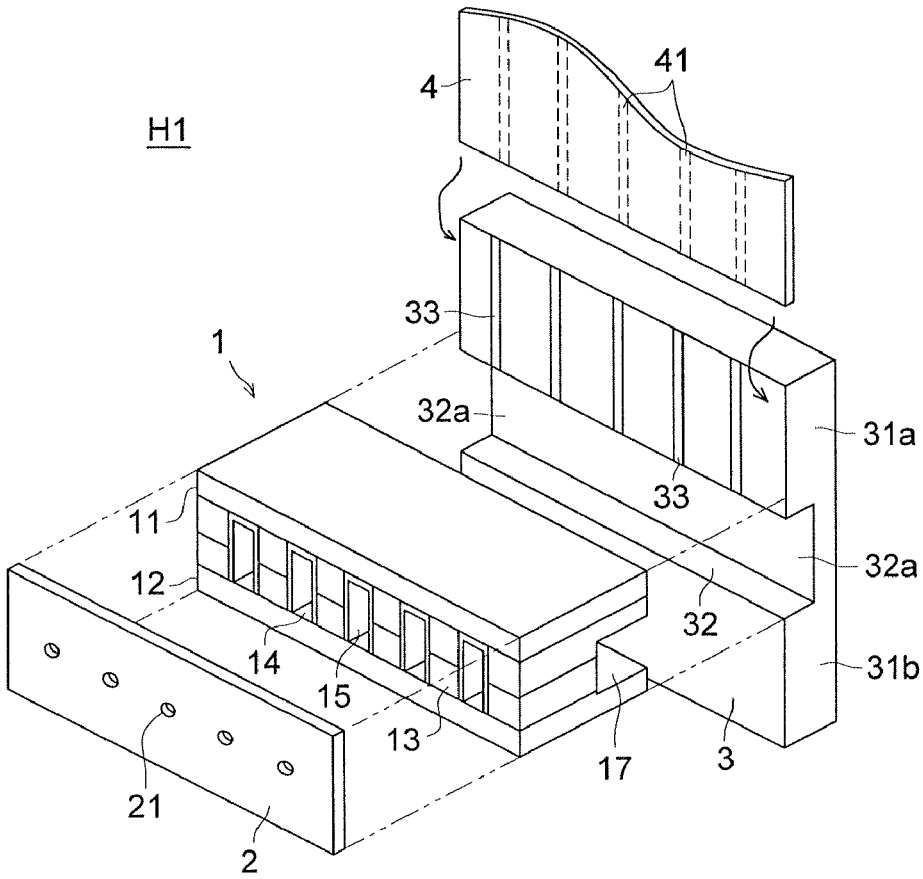
FIG. 9 is an exploded perspective view of an inkjet head related to the present invention.
Figure 10:
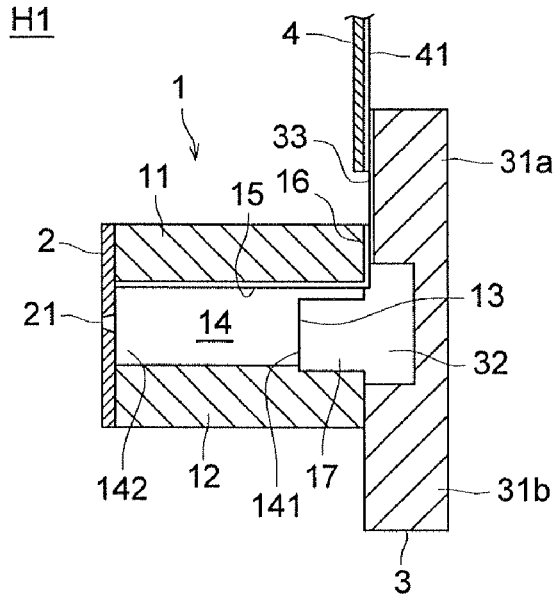
FIG. 10 is a cross-sectional view of an inkjet head related to the present invention.

In this way, after manufacturing head ships 1 each having various desired L length from head chips 1 having common length A by groove cutting for head chips 1, as FIG. 9 and FIG. 10 show, nozzle plate 2 where nozzle 21 is opened at position corresponding to each channel 14, is bonded to the front surface of head chip 1, and wiring substrate 3 to form a wiring connection section is bonded to the rear surface of head chip 1, thus, inkjet head H1 is manufactured. FIG. 9 is a perspective exploded view of an inkjet head and FIG. 10 is a cross-sectional view of the inkjet head.

Wiring substrate 3 is formed of a plate-shaped substrate which is composed of ceramic materials such as non-polarizing PZT, AIN-BN and AIN. Also, low heat expansive plastic and glass can be used. Further, it is preferred to use the same substrate material as a substrate material of piezoelectric element used for head chip 1 by processing depolarization. Also, to suppress a occurrence of distortion of head chip 1 caused by a difference of coefficient of thermal expansion, materials have to be selected so that the difference of coefficient of thermal expansion is within ±1 ppm.

In the structure of the present invention, the deeper groove 17 is made, the further an adhesion portion of wiring substrate 3 with head chip 1 becomes away from driving wall 13. In case a material having a coefficient of thermal expansion different from that of head chip 1 is used as substrate 3, a stress occurs by the difference of coefficient of thermal expansion when the temperature returns from heat bonding to normal, and may affect driving adversely. In the present invention, since a distance can be maintained between drive wall 13 and bonding portion, the effect can be minimized, and a material having different coefficient of thermal expansion from that of head chip 1 can be easily used as wiring substrate 3.

A material to compose the wiring substrate 3 is not limited to one solid plate, it can by formed by laminating a plurality of thin substrate materials to obtain desirable thickness.

This wiring substrate 3 has the same width as the width of head chip and has jetty sections 31*a* and 31*b* which largely project form upper surface and lower surface of head chip 1, extending in a direction (vertical direction in FIG. 9 and FIG. 10) perpendicular to a direction where channel 14 lines up (channel array direction). Also, on a surface of wiring substrate 3 where the rear surface of head chip 1 is bonded, concave section 32 extending across the width direction is formed.

On the wiring substrate 3, concave section 32 is formed in a size which is able to cover inlet port 141 side of all channels 14 along the channel array direction of head chip 1 by grooving. Thus, as FIG. 10 shows, the width of concave section 32 is larger than the height of channel 14 which is located in between substrate 11 and 12, and smaller than the thickness of head chip 1 in a direction (vertical direction of FIG. 10) perpendicular to the channel array direction. Therefore, when wiring substrate 3 is bonded to the rear surface of head chip 1, the bonding surface of substrate 3 contacts with substrate 11 and 12 on the rear surface of head chip 1, however inlet port 141 of channel 14 is not blocked and inlet port 141 of each channel 14 appear inside of concave section 32.

As forming methods of concave section 32, a method of grooving by a dicing saw, a method of grinding by supersonic processing machine and a method where ceramic before sintering is formed and calcined can be utilized.

Jetty section 31*a* represents one jetty section of wiring substrate 3 has a function as a bonding section with FPC4 (flexible printed circuit 4) and on its surface which comes to contact with head chip 1, wiring electrodes 33 are formed in the same pitch and the same number as connection electrodes 16 formed on the rear surface of head chip 1. When FPC4 is bonded, wiring electrode 33 is electrically connected with wire 41 of FPC4 and functions as an electrode so as to apply drive voltage from the drive circuit to each driving electrode 15 through connection electrode 16. In this way, since wiring electrode 33 is extended to jetty section 31*a*which is largely projecting form head chip 1, electrical connection with FPC4 is easy.

To form wiring electrode 33, a positive resist is coated on the surface of wiring substrate 3 through spin coat method, after that, the positive resist is exposed using a mask having a shape of stripe and developed, thus, the surface of wiring substrate 3 between the stripe-shaped positive resist is exposed in the same pitch and the same number as connection electrode 16, then a metal film can be formed with a metal used for forming electrode through evaporation method or spattering method. As the metal for forming electrode, the same material as connection electrode 16 can be used.

Meanwhile, in case of a head chip 1 having only one channel array, the jetty section of wiring substrate 3 is not necessary to project from both of the upper surface and the lower surface not as FIG. 9 and FIG. 10 show. It has only to exist on one side where FPC4 is bonded.

Wiring substrate 3 is positioned so that each wiring electrode 33 is electrically connected with each connection electrode 16 of head chip 1 and concave section 32 covers inlet port 141 of the channel of head chip 1, and is bonded onto the rear surface of head chip 1 with an anisotropic conductive film. As an electric connection method, besides the above method, methods used in ordinary mounting technology such as a method using a conductive particle including a anisotropic conductive past, pressure welding using nonconductive adhesive to bond, and a connection method where a solder is used at least either wiring electrode 33 or connection electrode 16 and is heated to melt.

In this way, by bonding wiring substrate 3 to the rear surface of head chip 1, the electrodes (connection electrode 16 and wiring electrode 33) representing wiring connection section to apply drive voltage from the drive circuit to driving electrode 15 in each channel 14 of head chip 1 are formed and a common ink chamber to supply ink to inlet ports 141 of each channel 14 are formed by one concave section 32 common for each channel 14 and by groove 17.

Ink supply to the common ink chamber can be realized by connecting an ink supply tube (unillustrated) to openings 32*a*which respectively open to both ends of concave section 32 when wiring substrate 3 is bonded onto the rear surface of head chip 1. Ink can be supplied from either both ends or one end. Also, ink can be supplied from one end and discharged from the other end so that ink can circulate through the common ink chamber. Since the common ink chamber is formed with concave section 32 and groove 17, it can acquire a large capacity compare to the one formed only with concave section 32.

Figure 11:
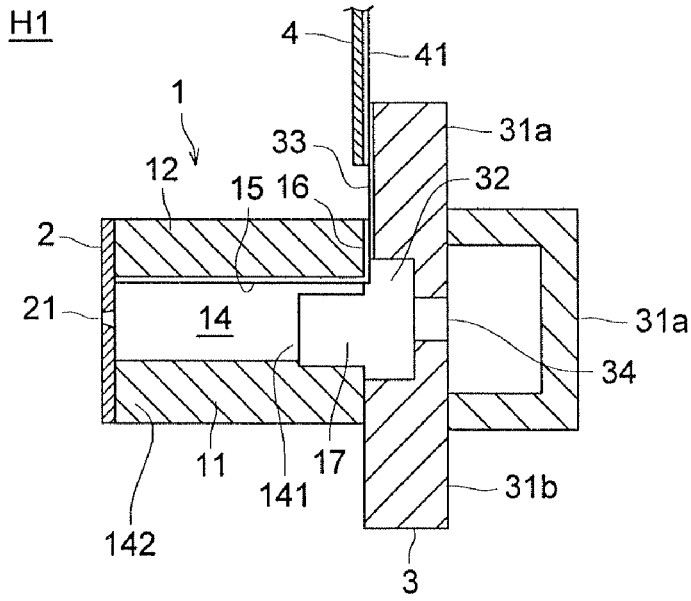
FIG. 11 is a cross-sectional view of an inkjet head having a manifold related to the present invention.

Further, to be capable of a large amount of ink supply, as FIG. 11 show, opening 34 is formed at a position of concave section 32 of wiring substrate 3 and box-shaped ink manifold 5 can be bonded to cover opening 34. A width (length in a vertical direction in FIG. 11) of opening 34 can be the same as a width of concave section 32. Also, a length of opening 34 in a channel array direction can be similar to a length of the channel array (FIG. 7(*c*)). In addition, opening 34 does not have to be one, and a plurality of openings 34 can be provided, thus, some can be used for supplying ink and others can be used for discharging ink so that ink can circulate through the common ink chamber. In case ink is supplied from opening 34, concave section 32 is not necessary to be formed up to the end of wiring substrate 3, it has only to be formed within a relevant area to C in FIG. 7.

Figure 12:
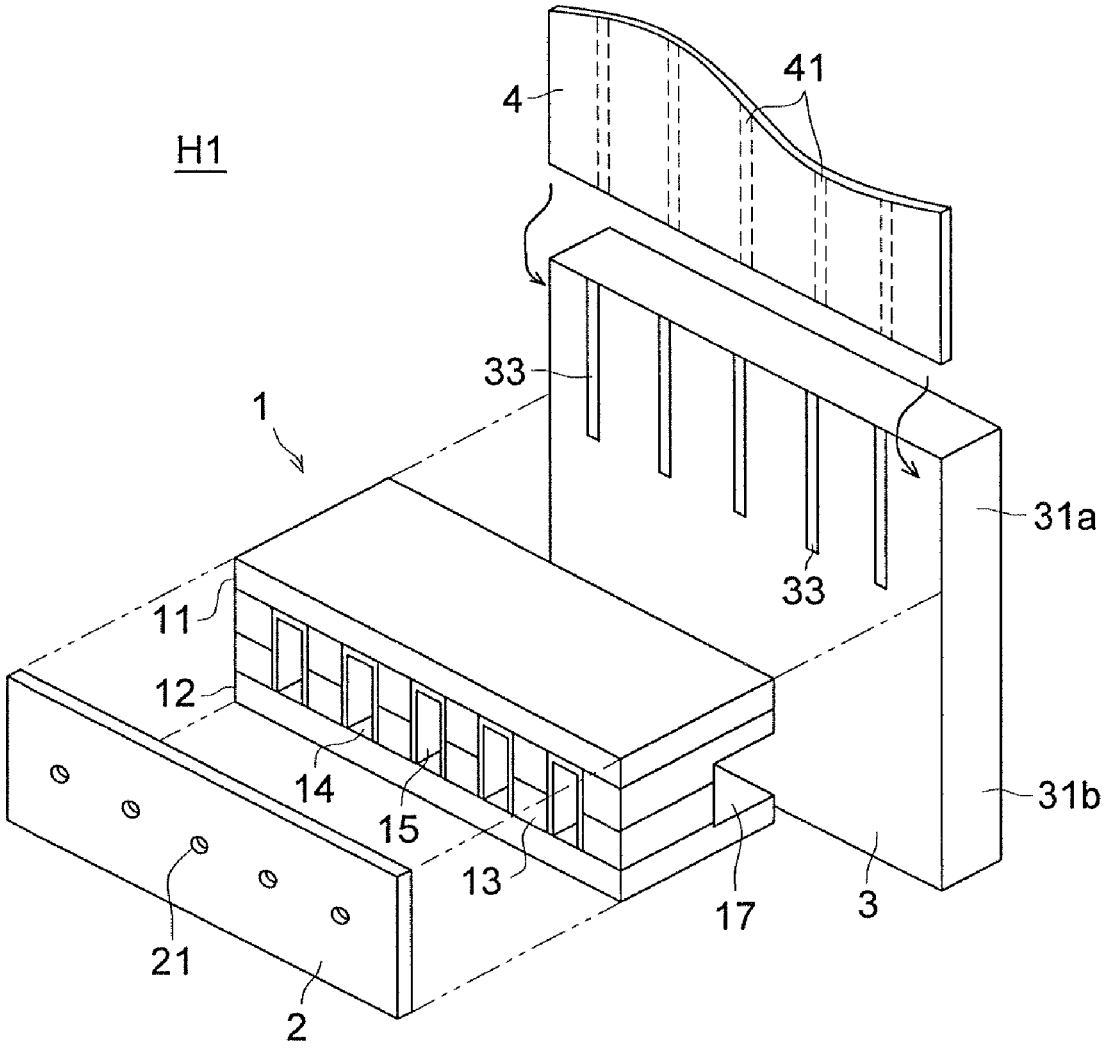
FIG. 12 is an exploded perspective view of an inkjet head provided with a wiring substrate related to the other embodiment.
Figure 13:
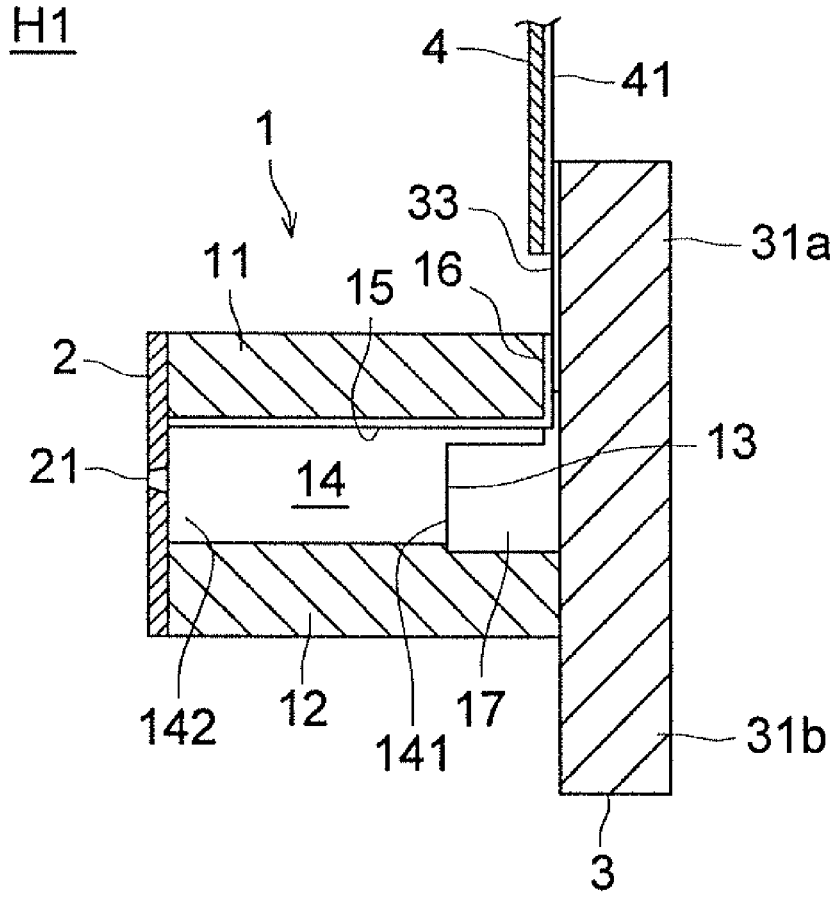
FIG. 13 is a cross-sectional view of an inkjet head provided with a wiring substrate related to the other embodiment.

Further more, since head chip 1 has groove 17, concave section 32 of wiring substrate 3 can be eliminated if groove 17 is utilized. An example is shown in FIG. 12. and FIG 13. By eliminating concave section from substrate 3, manufacturing of wiring substrate 3 is easy, also since a bonding area of head chip 1 and wiring substrate 3 increases, strength of bonding can be easily acquired. In case of lack of ink supply, it is preferred that opening 34 shown in FIG. 11 is provided on wiring substrate 3 and ink manifold 5 is bonded.

In the manufacturing method of the present invention, even if the length L of head chips 1 is varied to accord with required channel characteristics, the outer dimension of head chip 1 can remain unchanged to be a common length A which is favorable length for manufacturing, and when inkjet head H1 is mounted on an housing, a common housing can be used for head chips 1 having different L length, thus cost reduction can be realized.

Also, inkjet head H1 manufactured by this way can maintain strength and mounting workability to the housing, irrespective of required channel characteristics.

The inkjet head H1 explained above is an inkjet head having one channel array, however the head can have a plurality of channel arrays.

FIG. 14(*a*) and FIG. 14(*b*) are cross sectional views of inkjet head H2 having head chip 100 composed of 2 channel arrays. Since the portions represented by the same symbols as in FIG. 1 to FIG. 11, indicate the same portions, detailed explanation is omitted.

Two pieces of head substrata 10 shown in FIG. 1 (*b*) are prepared, and faces of two substrata 10 are bonded each other in the same orientation so that substrata 12 are in contact each other, and then bonded substrata 10 as a unit are cut along a cut lines to obtain head chip 100.

In case such head chip 100 is grooved, as shown in FIG. 14 (*a*), only one groove 17 having wide width common for each channel array can be formed by grooving across two channel arrays, also as FIG. 14 (*b*) shows, grooves 17 can be cut respectively for each channel array by grooving for each channel array.

Also in the former case, since unnecessary portion for driving is largely removed by groove 17, electric capacity can be reduced and heat generation when driving can be suppressed by lowering drive voltage. Also, since the capacity of the common ink chamber can be made large, supply of ink is easy and the depth of concave section 32 does not have to be too deep.

Also, in the later case, portions of substrates 12 remains between two grooves 17 by cutting. At this stage, as the drawing shows, by forming two concave sections 321 and 322 on wiring substrate 3 to correspond with each channel array, individual common ink chambers for each channel array are formed, then, since the common ink chambers are separated for each channel array by substrata 12 and spaces between concave sections 321 and 322, different color of ink can be supplied respectively to each channel array.

Meanwhile, in the present invention, the connection method of wire to apply drive voltage to each driving electrode 15 of head chip 1 and 100 is not limited to the method by wiring substrate 3, and various methods can be utilized.

EXAMPLE

Based on the present invention, an inkjet head having a head chip in which 256 channels having L length of 1.3 mm arranged in a pitch of 141 μm and a groove having a depth of 1.2 mm are formed was manufactured. Outer dimensions of the head chip are 2.5 mm in a length, 45 mm in a width and 2 mm in a thickness, and the head structure was a structure shown in FIG. 11.

A speed distribution of the completed inkjet head was measured. The speed distribution was not more than ±10% and no damage occurred during manufacturing. This inkjet head can be operated at a drive frequency of 40 kHz, namely the inkjet head capable of high speed driven was easily manufactured.

COMPARATIVE EXAMPLE

Not based on the present invention, an inkjet head having a head chip in which 256 channels having L length of 1.3 mm are arranged in a pitch of 141 μm and the groove is not cut, was manufactured. Outer dimensions of the head chip are 1.3 mm in a length, 45 mm in a width and 2 mm in a thickness, and the head structure was a structure shown in FIG. 11 where the groove is not cut).

A speed distribution of the completed inkjet head was measured. The speed distribution was not flat and more than ±20% was observed. This is considered that distortion occurred during manufacturing due to insufficient strength. Also it is considered that because the driving wall and the wiring substrate are close each other, a stress generated at adhesion process affected to the driving wall. Further, during washing process, breakages occurred by water pressure.

In this way, in the present invention, an inkjet head having short L length capable of high speed driven can be easily manufactured.

What is claimed is:

1. A method of manufacturing an inkjet head having a head chip to jet ink in each channel from a nozzle by causing shear deformation to a driving wall by applying voltage to a driving electrode, comprising steps of:

forming a plurality of driving walls composed of piezoelectric elements and channels alongside alternatively in the head chip;

providing outlet ports and inlet ports respectively on a front surface and a rear surface of the head chip;

forming the driving electrodes in the channels to apply voltage so as to drive the driving walls; and recessing the rear surface of the head chip by cutting at least portions of the driving walls across the channels to form a groove that communicates with each channel; and covering the groove from the rear surface to form an ink supply channel to supply ink commonly to inside each channel.

2. The method of manufacturing the inkjet head of claim 1, wherein the groove is cut so as to obtain a desired drive length (L length).

3. The method of manufacturing the inkjet head of claim 1, wherein the groove is cut through a dicing saw along the channel array.

4. The method of manufacturing the inkjet head of claim 1, wherein the groove is cut with leaving portions of the driving electrodes.

5. The method of manufacturing the inkjet head of claim 1, wherein a plurality of channel arrays are formed and the groove is cut to correspond with each channel array.

6. The method of manufacturing the inkjet head of claim 1, wherein a plurality of channel arrays are formed and the groove is cut across the channel arrays.

7. The inkjet head of claim 1, wherein connection electrodes to be connected with driving electrodes electrically are formed on the rear surface of the head chip, a wiring substrate in which wiring electrodes corresponding to the connection electrodes are formed is bonded so that the connection electrodes are electrically connected with ends of the wiring electrodes, the wiring substrate has a jetty section which projects from the head chip in a direction perpendicular to the channel array, and the other ends of the wiring electrodes are extended up to the jetty section.

8. The inkjet head of claim 1, wherein the wiring substrate has a concave section which extents along a direction of the channel array on a bonding surface with the head chip, and an ink supply chamber to supply ink commonly to inside each channel is formed by bonding the wiring substrate on the rear surface of the head chip so that the concave section covers the inlet port of each channel.

9. The inkjet head of claim 1, wherein the wiring substrate has an opening section which opens at least to the inlet port of each channel, and the opening section forms a common ink chamber so as to supply ink commonly to inside of each channel.

10. The inkjet head of claim 1, wherein a drive length (L length) of the channel is 0.5 to 1.5 mm and a head chip length is 1.5 mm to 2.5 mm.

* * * * *